US010118280B2

(12) United States Patent
Bigot

(10) Patent No.: US 10,118,280 B2
(45) Date of Patent: Nov. 6, 2018

(54) DEVICE FOR APPLYING TEMPORARY FASTENERS

(71) Applicant: LISI AEROSPACE, Paris (FR)

(72) Inventor: Frederic Bigot, Reuilly (FR)

(73) Assignee: LISI AEROSPACE, Paris (FR)

( * ) Notice: Subject to any disclaimer, the term of this patent is extended or adjusted under 35 U.S.C. 154(b) by 165 days.

(21) Appl. No.: 14/891,442

(22) PCT Filed: May 20, 2014

(86) PCT No.: PCT/EP2014/060337
§ 371 (c)(1),
(2) Date: Nov. 16, 2015

(87) PCT Pub. No.: WO2014/187821
PCT Pub. Date: Nov. 27, 2014

(65) Prior Publication Data

US 2016/0129567 A1 May 12, 2016

(30) Foreign Application Priority Data

May 22, 2013 (FR) ..... 13 54604

(51) Int. Cl.
*B25B 21/00* (2006.01)
*B25B 31/00* (2006.01)

(52) U.S. Cl.
CPC ..... *B25B 21/002* (2013.01); *B25B 31/005* (2013.01)

(58) Field of Classification Search
CPC ..... B25B 21/002; B25B 31/005; B25B 31/00; B25B 13/00; B25B 13/46; B25B 15/04; B25B 13/462; Y10T 408/63
See application file for complete search history.

(56) References Cited

U.S. PATENT DOCUMENTS 2,613,942 A * 10/1952 Saunders ..... B25B 13/5066 279/72
2,819,635 A * 1/1958 Better ..... B25B 23/14 192/56.5

(Continued)

FOREIGN PATENT DOCUMENTS

| | | |
|---|---|---|
| EP | 0 336 808 A1 | 10/1989 |
| EP | 0 466 609 A1 | 1/1992 |
| GB | 2 126 146 A | 3/1984 |

OTHER PUBLICATIONS

Radu, David, International Search Report, dated Jul. 3, 2014, 2 pages, PCT/ISA European Patent Office.

*Primary Examiner* — Robert Scruggs
(74) *Attorney, Agent, or Firm* — Henricks Slavin LLP

(57) ABSTRACT

The invention relates to a tool (15) for installing fasteners, said tool comprising:

Figure 1:
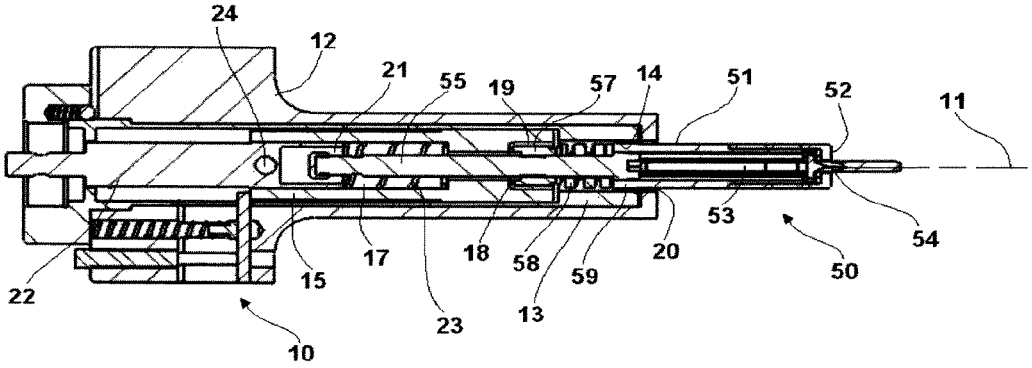

- a sheath containing a cylindrical housing (18) with a polygonal base,
- a roller cage (19) accommodated within said cylindrical housing, said cage comprising:
  - a cylindrical support (33) with a substantially circular base, capable of pivoting within the cylindrical housing.
  - rollers (34) disposed on the perimeter of the support, each roller being able to rotate with respect to said support,
  - a compressing spring (36) exerting a radial force on the rollers in the direction of the main axis,
- the tool further comprising a restoring member (37) tending to bring the rollers of the cage to face the edges (27) of the cylindrical housing of the sheath.

7 Claims, 2 Drawing Sheets

(56) References Cited

U.S. PATENT DOCUMENTS 4,787,274 A * 11/1988 Belanger ..... B25B 31/005
81/57.15
5,406,866 A * 4/1995 Badiali ..... B25B 15/02
81/57.3

* cited by examiner

DEVICE FOR APPLYING TEMPORARY FASTENERS

CROSS REFERENCE TO RELATED APPLICATIONS

This application is a National Stage of International Application No. PCT/EP2014/060337, filed May 20, 2014, published as WO 2014187821, which claims priority to France Patent No. 1354604 filed May 22, 2013. The disclosures of the aforementioned publications are incorporated herein by reference thereto.

The present invention relates to a device for fitting fasteners, particularly for temporary fasteners of the clamp type.

In the aeronautical industry, before carrying out the final assembly of metal sheets or similar elements, it is common practice to carry out a temporary assembly of the sheets using temporary fasteners inserted into through holes.

Such temporary fasteners—for example, those described in documents GB2126146 or EP0336808—typically comprise the following:

a body with a bearing face capable of coming into contact with a front face of the structures to be assembled at least one clip, intended to be passed through the drilled holes, with a hooking spur that can be applied against a rear face of the structures to be assembled a mechanism that can be moved relative to the body, comprising a threaded rod placed coaxially to the body, with one end of the rod extended by the clip, and a control nut screwed onto the other end of the rod.

These fasteners are generally fitted to the metal sheets using a motorized device like an electric screwdriver, equipped with an installation device comprising:

a first cylindrical sheath that locks the body of a fastener in place once inserted, a second cylindrical sheath housed within the first sheath that prevents rotation of the fastener body, a third cylindrical sheath housed within the second, the third sheath being rotated by the motorized device, with one end of the third sheath rotating the control nut on the fastener.

Such an installation device is described in document EP0466609.

When rotating, the nut moves the fastener's threaded rod, so that the hooking spurs and the body's bearing face are applied respectively to the rear and front faces of the stacked metal sheets. A predetermined tightening torque is generally applied to the fastener when it is installed.

The second and third sheaths of the installation device are fitted with means for rotating and for rotationally immobilizing, respectively, the body and nut of the fastener. When the body or nut has a polygonal cross-section, those means for rotating and for rotationally immobilizing may be formed by a recess of a complementary shape.

On the other hand, when the body or the nut has a circular cross-section, a wedging driving system should be used, like a roller cage. Such a roller cage is described in document EP0466609.

The roller cage is typically installed to freely rotate within a housing with a polygonal cross-section, whose faces mate with the rollers during the operation of the installation device.

However, depending on the angular position of the rollers relative to the faces, problems may arise when installing the temporary fasteners. Misalignment may cause excessive friction, which impedes the installation of the fasteners and/or causes damage to the control nut.

If the fasteners are being installed manually, operators can overcome these problems by accurately manipulating the installation device. However, in automatic mode, installation robots do not currently possess such skills.

It is therefore necessary to avoid misaligning the roller cage in the installation device at the time when temporary fasteners are inserted in the device.

The present invention seeks to solve this problem by equipping the installation device with a means for optimally positioning the roller cage.

More specifically, the present invention relates to a fastener installation tool, said tool comprising: a sheath disposed along a main axis, said sheath containing a cylindrical internal housing with a polygonal base, extending along the main axis; a roller cage, housed in said cylindrical housing, said cage comprising: a cylindrical mount with a substantially circular base, arranged along the main axis, an external lateral surface of said mount being substantially tangent to side faces of the cylindrical housing with a polygonal base; rollers arranged around the perimeter of the mount, each roller being rotationally mobile relative to said mount around an axis parallel to the main axis; a compression spring exerting a radial force onto the rollers in the direction of the main axis; the cage being configured such that each roller is housed in one edge of the cylindrical housing of the sheath; the mount of the cage being able to pivot around the main axis inside said cylindrical housing. The installation tool further comprises a restoring member, connected to a roller of the cage and to the sheath, said restoring member tending to bring the rollers of the cage to face the edges of the cylindrical housing of the sheath.

Preferentially, the restoring member is a torsion spring.

Thus, although the roller cage rotates within its housing while the fasteners are being installed, the restoring member brings the cage to its optimal position at the end of installation.

In the context of the invention, the term "tool" refers both to complete installation device, and to a part of said device, such as a socket wrench of the control nut.

Preferentially, the tool is intended to install temporary fasteners comprising: a longitudinal body provided with a front face, at least one clip emerging from said front face, a threaded rod coaxial with the body and translationally movable along said axis, one end of the rod being extended by the clip, a control nut mounted on another end of the rod.

Such an installation tool can also be adapted to install a fastening nut with a cylindrical outer shape, as well as any fastener incorporating such a nut.

According to one embodiment of the invention, the nut has a circular cross-section and the tool is configured so that the nut can be inserted into the roller cage, whereupon an external lateral surface of the nut comes in contact with the rollers. In this embodiment, the tool is, for example, a socket wrench driving the nut.

Preferentially, another element of the complete installation device or tool comprises a means of preventing the rotation of the longitudinal body.

According to another embodiment of the invention, the longitudinal body has an end with a circular cross-section and the tool is configured so that said end can be inserted into the roller cage, whereupon an external lateral surface of the nut comes in contact with the rollers. In this embodiment, the tool is, for example, a front part, or nose, of an electric screwdriver.

Preferentially, another element of the complete installation device or tool comprises a means of rotating the nut.

Figure 2:
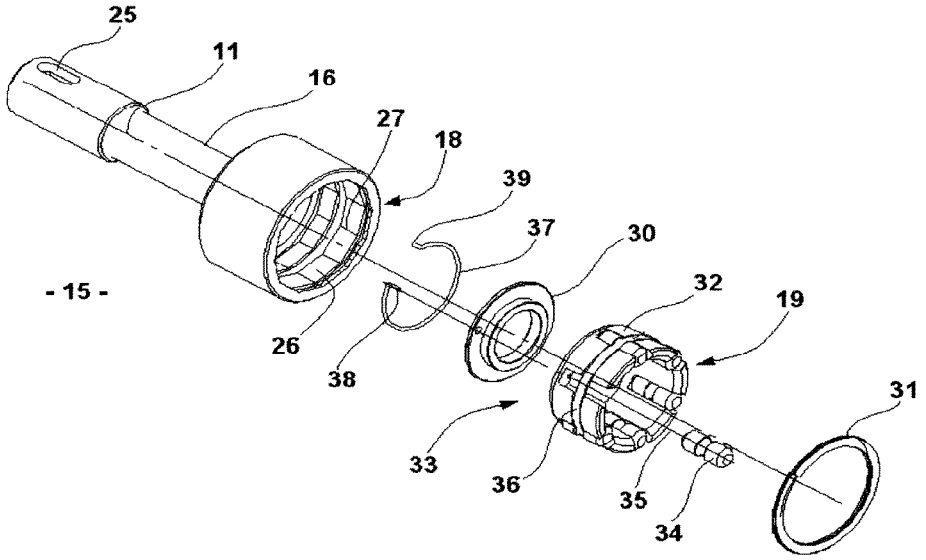
Figure 3A:
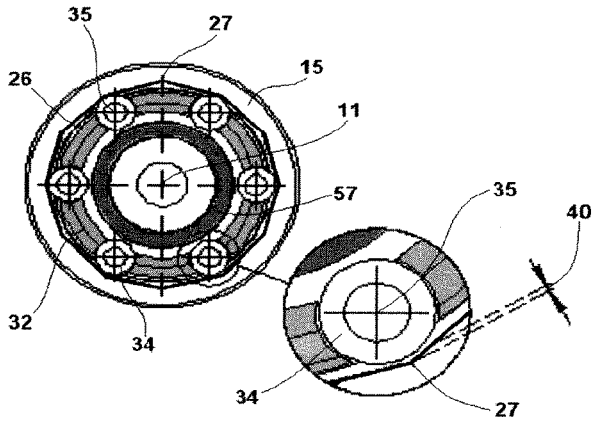
Figure 3B:
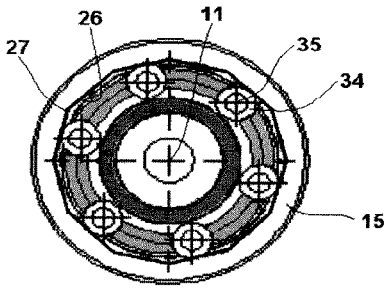
Figure 4:
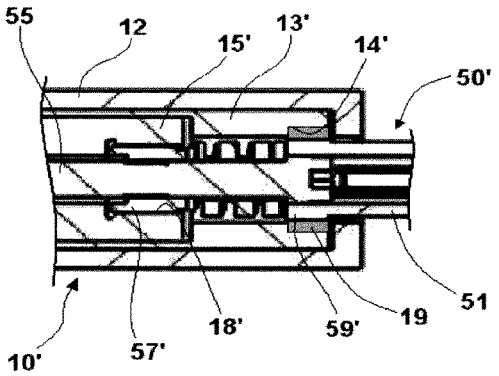

The invention will be better understood when reading the following description and examining the accompanying figures. These are provided for information purposes only and are not exhaustive concerning the invention. The figures illustrate the following:

FIG. 1: An axial cross-section view of a fastener installation device according to one embodiment of the invention;

FIG. 2: An exploded view of a portion of an installation device according to one embodiment of the invention;

FIGS. 3A and 3B: Partial transversal cross-section views of the device of FIG. 1;

FIG. 4: A partial axial cross-section view of a fastener installation device according to another embodiment of the invention.

FIG. 1 illustrates a cross-sectional schematic view of a device 10 for installing a clamping fastener 50.

The fastener 50 comprises a substantially cylindrical body 51 placed on an axis 11. The body 51 has a front bearing face 52 capable of coming into contact with one face of the elements to be assembled, such as drilled metal sheets.

The fastener 50 also comprises two extended half-clips 53, each with a hooking spur 54 that can be applied against the other face of the metal sheets to be assembled via the lined-up holes drilled in them.

The fastener 50 also comprises a threaded rod 55 placed on the axis 11, which can be moved relative to the body 51. One end of the rod is attached to the two half-clips 53. A control nut 57 is screwed onto the thread on said rod.

Furthermore, a compression spring 58 is placed around the rod 55 on the axis 11, between the nut 57 and one end 59 of the body 51, opposite the bearing face 52.

The installation device 10 comprises a first cylindrical sheath 12 placed on the axis 11. The first sheath 12 marks out a first internal cavity within which is disposed, along axis 11, a second sheath 13.

Movement of the fastener 50 body towards the bearing face 52 is prevented by the first sheath 12, which forms an axial stop against the end 59 of the body 51.

The second sheath 13 is positioned so that it interacts with the end 59 to stop the body 51 rotating around the axis 11. The end 59 has, for example, a hexagonal section near to an axial opening 20 and the second sheath 13 has an inner wall 14 with the same shape as that section.

The second sheath 13 marks out a second internal cavity into which the end 59 of the body 51 is inserted, while the rest of the body extends outside the device 10 via the axial opening 20.

The installation device 10 further comprises a sleeve 15 housed in the second internal cavity. The sleeve 15 can be rotated and moved inside said second internal cavity, on the axis 11.

The sleeve 15 forms a third inner cavity 17, open at both ends of the sleeve, on the axis 11. A portion of the cavity 17 forms a housing 18, of which the side wall is cylindrical with a polygonal base, extending along the axis 11. The housing 18 is, for example, a lateral surface with twelve sides, i.e. a cross-section forming a regular dodecagon.

The housing 18 accommodates a roller cage 19, whose operation shall be detailed below.

One end 21 of the cavity 17 houses a drive shaft 22 intended to be connected to an output shaft of an electric screwdriver. The sleeve 15 can be moved on the axis 11 relative to the shaft 22, which is prevented from moving relative to the first sheath 12. A compression spring 23, housed in the end 21 of the cavity 17 and supported against the shaft 22, tends to push the sleeve 15 towards the opening 20.

The shaft 22 is thus able to rotate the sleeve 15 around the axis 11 using a pin 24.

FIG. 2 shows an exploded view of a sleeve 15 similar to the sleeve 15 of FIG. 1. The reference numbers are the same as in FIG. 1.

The sleeve 15, or socket wrench, comprises a sheath 16 disposed along a main axis 11, said sheath creating an internal cavity. A portion of said internal cavity forms a housing 18, cylindrical with a polygonal base, extending along the axis 11. As in FIG. 1, the polygonal base is, for example, a regular dodecagon.

In FIG. 2, there is also a transverse perforation 25 of the sheath 16, intended to accommodate the pin 24 described above.

The cylindrical housing 18 accommodates a roller cage 19. Said cage is formed of a loop 30 and an elastic ring 31, arranged along the axis 11 and connected by spacers 32. The loop 30, ring 31, and spacers 32 form a cylindrical support 33 with a substantially circular base. The support 33 is configured such that the spacers 32 are substantially tangent to lateral surfaces 26 of the housing 18.

The cage 19 further comprises rollers 34 arranged around the perimeter of the support 33, between the spacers 32. Each roller 34 can rotate with respect to the support 33 around an axis 35 parallel to the main axis 11. In the example in FIG. 2, the rollers 34 are distributed along six axes 35, disposed around the axis 11 in a regular hexagon.

Furthermore, cage 19 comprises a compression spring 36 disposed around spacers and rollers. The spring 36 exerts a radial force on the rollers 34 in the direction of the axis 11.

When the fastener 50 is inserted into the device 10 with a view to installing it (see FIG. 1), the control nut 57 with a circular cross-section fits into the roller cage 19 of the sleeve. The spring 36 enables the rollers 34 to radially press against the lateral surface of the nut 57. When the sheath 16 is rotated by the shaft 22, the lateral sides 26 or faces of the housing 18 mate with the rollers 34, which themselves mate with the lateral surface of the nut 57. The nut is rotated by the meshing of the rollers 34 between the edges 26 and said nut.

FIGS. 3A and 3B show transverse cross-section views of the socket wrench 15 in which the fastener 50 is inserted. The cross-section plane passes through the roller cage 19 and the nut 57.

FIG. 3A shows the socket wrench 15 in a configuration before screwing/unscrewing, making it possible to correctly install the fastener 50. In the inset, a detailed view of a roller 34 is shown.

In the configuration of FIG. 3A, each of the rollers 34 is facing an edge 27 that delimits two lateral faces 26 of the housing 18. More specifically, each rotational axis 35 of a roller is located within a plane that passes through the main axis 11 and through an edge 27.

As the housing 18 comprises twelve faces 26 and twelve edges 27, one edge out of every two is facing a roller 34. There is a clearance 40 between each roller 34 and the edge 27 facing it. This configuration of the cage 19 enables the socket wrench 15 to exert an optimal force on the nut 57 during screwing.

FIG. 3B shows the socket wrench 15 in another configuration before screwing/unscrewing, one which is unfavorable to correctly installing the fastener 50. In this configuration, the rollers 34 are shifted with respect to the edges 27.

Each roller 34 is in contact with a single face 26 of the housing 18, with no clearance.

In the devices of the prior art, the roller cage is free to rotate along the main axis in the housing with a polygonal cross-section. It is therefore possible for the cage to be in the configuration of FIG. 3B when a control nut is inserted.

Such a configuration causes excessive force during the installation of the fastener 50. If the device 10 exerts insufficient force on the wrench 15, the rotation of the nut will be defective. If greater force is exerted by the device 10, the nut 57 may be damaged by the friction of the rollers 34.

The present invention therefore includes a means of moving the rollers into the position of FIG. 3A before inserting any temporary fastener into the roller cage.

In the example in FIG. 2, this means is in the form of a torsion spring 37. The spring 37 has the shape of a wire wound around the axis 11. A first end 38 of the spring 37 is connected to a roller 34 of the cage 19. A second end 39 of the spring 37 is connected to the sheath 16. The end 39 is, for example, housed in a radial notch (not depicted) built into an internal surface of the sheath.

The spring 37 tends to move the rollers 34 of the cage 19 into the configuration shown in FIG. 3A, said rollers facing an edge 27.

When a screwing/unscrewing torque is applied to the wrench 15, the spring 37 deforms as a result of the inertia of the cage 19, thereby rotating the nut 57. When the screwing/unscrewing stops, the spring 37 pivots the cage 19 to restore it to its initial configuration, as depicted in FIG. 3A.

Thus, before inserting a fastener 50 into the device 10 of FIG. 1, the position of the cage 19 in the wrench 15 is necessarily optimal for installing said fastener.

FIG. 4 depicts a detailed view of one variant embodiment of the invention. More specifically, FIG. 4 depicts a detailed view of a fastener 50' similar to the fastener 50 depicted in FIG. 1, inserted into an installation device 10' similar to the device 10 of FIG. 1. The references of the elements in common with FIG. 1 are kept the same below.

One difference between the fastener 50' and the fastener 50 of FIG. 1 is the shape of a control nut 57', similar to the nut 57. More specifically, the nut 57' has a hexagonal, not circular cross-section.

In FIG. 4, the nut 57' is housed in a sleeve 15' similar to the sleeve 15. More specifically, the sleeve 15' comprises a housing 18' whose shape complements that of the nut 57'. The housing 18' therefore has a cylindrical shape with a hexagonal base. When the sleeve 15' is rotated, the surface of the housing 18' mates directly with the nut 57' to rotate it as well.

Another difference between the fastener 50' and the fastener 50 of is the shape of one end 59' of the body 51. In the example in FIG. 4, the end 59' has a circular cross-section, unlike the six-faces shape of the end 59 of FIG. 1.

As in the example in FIG. 1, a second sheath 13' of the device 10' mates with the end 59' to prevent the body 51 from rotating along the axis 11. Near an axial opening, the second sheath 13' has an internal housing 14', as will the housing 18 of FIGS. 1 and 2. This housing 14' contains a roller cage 19, the same as the one described previously in support of FIGS. 1 and 2. The other parts of the device 10' and the fastener 50' are the same as the ones in the device 10 and fastener 50 depicted in FIG. 1.

When the nut 57' is rotated, the end 59' of the body 51 is prevented from rotating by the meshing of the rollers of the cage 19 against the sides of the internal housing 14', in the same manner as described above. The nut 57' may then be moved along the threaded rod 55 to install the fastener 50'.

For the same reasons as described above, optimal installation of the fastener 50' requires that the cage 19 of FIG. 4 be in the configuration depicted in FIG. 3A before inserting the end 59' of the body 51, which then takes the place of the nut 57. The cage 19 in FIG. 4 therefore includes a spring 37 identical to the one described previously, said spring ensuring that the cage 19 returns to its optimal configuration after the fastener 50' has been installed.

It is also possible to conceive a fastener comprising a circular nut 57 and a circular end 59' on the body 51. In such a case, it is possible to combine the examples of FIGS. 1 and 4, so that said nut 57 and said end 59' each mate with a roller cage 19 as previously described, each cage returning to its initial position after installation, with the assistance of a torsion spring.

Although the restoring member of the invention has been described in the examples as being formed by a torsion spring, it is understood that this example is non-limiting. Any equivalent means making it possible to bring back the rollers of the cage to face the edges of the cylindrical housing of the sheath is comprised in the invention.

The invention claimed is:

1. A tool for installing fasteners, said tool comprising:
- a sheath disposed along a main axis, said sheath containing a cylindrical internal housing with a polygonal base, extending along the main axis,
- a roller cage accommodated within said cylindrical housing, said cage comprising:
  - a cylindrical support with a substantially circular base, disposed along the main axis, an external lateral surface of said support being substantially tangent to lateral surfaces of the cylindrical housing with a polygonal base,
  - rollers disposed on the perimeter of the support, each roller being able to rotate with respect to said support around an axis parallel to the main axis,
  - a compressing spring exerting a radial force on the rollers in the direction of the main axis,
- the cage being configured such that each roller is housed in an edge of the cylindrical housing of the sheath,
- the support of the cage being able to pivot around the main axis within said cylindrical housing,
- the tool being characterized in that it comprises a restoring member, connected to a roller of the cage and to the sheath, said restoring member tending to bring the rollers of the cage to face the edges of the cylindrical housing of the sheath.

2. A fastener installation tool according to claim 1, wherein the restoring member is a torsion spring, one end of said spring being connected to a roller cage, another end of said spring being connected to the sheath.

3. A tool according to claim 1 or claim 2, intended for installing temporary fasteners comprising:
- a longitudinal body with a front face,
- at least one clip emerging from said front face,
- a threaded rod coaxial to the body and movable along said axis, one end of the rod being extended by the clip,
- a control nut mounted on another end of the rod, said nut being of circular exterior cross-section,
- said tool being configured so that the nut can be inserted into the roller cage, whereupon an external lateral surface of the nut comes in contact with the rollers.

4. A tool according to claim 3, such that the sheath is inserted into an outer envelope disposed along the main axis, said envelope comprising a means of keeping the longitudinal bodies of the temporary fasteners from rotating when the nut is rotated around the main axis.

5. A tool according to claim 4, such that the sheath is connected to a means of rotation around the main axis.

6. A tool according to claim 1 or claim 2, intended for installing temporary fasteners comprising:

a longitudinal body provided with a front face, said body having an end with a circular cross-section, at least one clip emerging from said front face, a threaded rod coaxial to the body and movable along said axis, one end of the rod being extended by the clip, a control nut mounted on another end of the rod, said tool being configured so that said end of the longitudinal body can be inserted into the roller cage, whereupon an external lateral surface of said end comes in contact with the rollers.

7. A tool according to claim 6, further comprising a sleeve inserted into the sheath and disposed along the main axis, said sleeve comprising a means of rotating the nut of the temporary fasteners around the main axis.

* * * * *